United States Patent [19]

Bushey

[11] Patent Number: 4,569,442

[45] Date of Patent: Feb. 11, 1986

[54] RECLOSABLE BLISTER PACKAGE

[76] Inventor: Richard D. Bushey, 3521 16th Ave., Kenosha, Wis. 53140

[21] Appl. No.: 698,459

[22] Filed: Feb. 5, 1985

[51] Int. Cl.[4] ..... B65D 73/00

[52] U.S. Cl. ..... 206/469; 206/470; 206/623; 206/629

[58] Field of Search ..... 206/467, 469, 470, 620, 206/630, 631, 634, 623, 629

[56] References Cited

U.S. PATENT DOCUMENTS

| | | | |
|---|---|---|---|
| 3,428,171 | 2/1969 | Blish | 206/469 |
| 3,463,309 | 8/1969 | Szostek | 206/470 |
| 3,857,487 | 12/1974 | Misslin | 206/470 |
| 4,091,930 | 5/1978 | Buchner et al. | 206/469 |
| 4,319,684 | 3/1982 | Backman et al. | 206/467 |
| 4,499,353 | 2/1985 | Shields | 206/470 |

*Primary Examiner*—Joseph Man-Fu Moy
*Attorney, Agent, or Firm*—John C. Shepard

[57] ABSTRACT

A reclosable blister package includes a carrier and a blister with hinged top and bottom portions, the top portion having a scored peripheral flange. When the top and bottom portions are folded together, the flange is secured to the carrier to hold the unsecured bottom portion closed between the carrier and the top portion to seal the package. The score allows the blister to be detached from its flange, removed from the carrier and unfolded to an open condition.

6 Claims, 6 Drawing Figures

RECLOSABLE BLISTER PACKAGE

BACKGROUND OF THE INVENTION

1. Technical Field

This invention relates generally to a display container and, more particularly, to a reclosable blister package.

2. Background Art

In the prior art, blister packages are well known. Typically, a clear plastic blister is fused to a cardboard backing and is formed to define a bubble or cavity in which merchandise or product is be carried. In early forms, the blister had one open side and was fixed directly to the cardboard. When the package was opened, the blister was ruptured or the backing was ripped away, the product removed and the entire package was thrown away. In later forms, where the blister can be reclosed to store unused product, the blister has top and bottom portions and is sealed shut by tape or sealed between two plies of diecut cardboard punched to provide a mounting hole for the blister. In some packages, locking tabs are employed to keep the blister portions closed together while mounted on the backing.

In the reclosable constructions, manufacturing, filling and sealing of the packages is fairly involved. Sealing blisters by tape or between two cardboard plies involves additional components. Use of locking tabs requires the cutting of tab-receiving slots and means to prevent opening of the package before sale.

SUMMARY OF THE INVENTION

The present invention is directed to overcoming one or more of the problems as set forth above.

According to the present invention, a reclosable blister package includes a carrier and a blister having a top portion and a bottom portion hinged to fold together and close a product carrying cavity defined therebetween. The top portion has a peripheral flange which extends beyond the bottom portion and is secured to the carrier so that the unsecured bottom portion is disposed between the carrier and the top portion to seal the package closed. Score means between the secured part of the flange and the remainder of the blister permit the blister remainder to be removed from the carrier thereby allowing the blister to be opened by unfolding the bottom portion from the top portion.

In an exemplary embodiment of the invention, the score means is a series of perforations extending from the hinge portion of the blister around and adjacent to the product carrying cavity of the blister.

In a preferred embodiment of the invention, the top portion flange is formed with at least a portion thereof displaced downward to define a recess adapted to receive a peripheral flange of the bottom portion.

In an alternative embodiment of the invention, the bottom portion has no flange and the top portion is formed without a recess.

A further feature of the invention is a locking tab and slot on respective mating parts of the top and bottom portions to hold the blister in folded condition.

Another feature of the invention is that the blister may be integrally constructed from a single piece of thermoplastic material and mounted to a flat, uncut carrier card.

BRIEF DESCRIPTION OF THE DRAWINGS

The details of construction and operation of the invention are more fully described with reference to the accompanying drawings which form a part hereof and in which like reference numerals refer to like numerals throughout.

In the drawings.

DESCRIPTION OF THE PREFERRED EMBODIMENTS

Best Modes for Carrying Out the Invention

Figure 1:
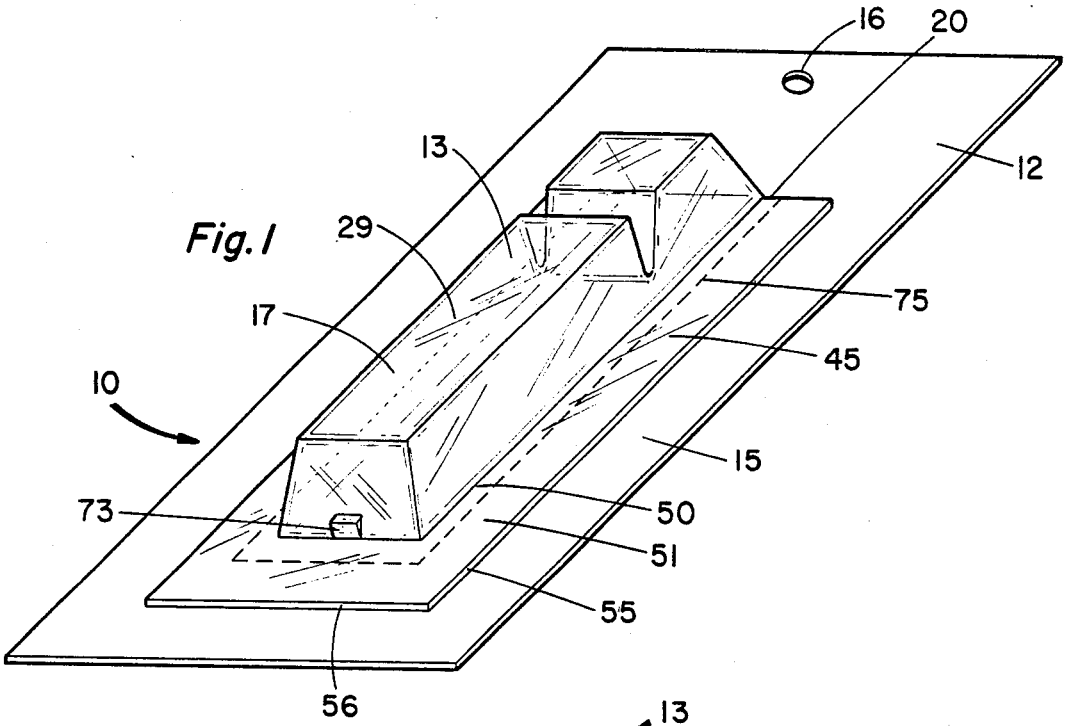
FIG. 1 is a perspective view of a blister package showing a folded plastic blister mounted on a carrier.

Referring to FIG. 1 of the drawings, a reclosable blister package, generally designated 10, is comprised of a flat, uncut, single-ply cardboard carrier, generally designated 12, and a product-carrying container, or blister, generally designated 13. The carrier 10 has a front mounting surface 15 to which the blister 13 is affixed, as by heat sealing or adhesive, a back surface (not numbered), and a punched hole 16 adjacent the top edge thereof to permit the carrier 12 to be placed on a display hook (not shown). The front surface 15 and the back surface may have printed thereon advertising and use instructions for any product held by the blister.

Referring to FIGS. 2 through 5, the blister 13 is integrally formed or molded from a single piece of clear thermoplastic of a type commonly known and used in the prior art. The blister 13 has a top portion 17 and a bottom portion 18 joined at their respective inward ends 20 and 21 by a hinge portion, or flexible segment 23, defining a "living" hinge line extending across the midsection of the blister 13.

The top portion 17 has slanted, upwardly extending side walls 25, slanted, upwardly extending outward and inward end walls 26 and 27, respectively, and a top wall 29 forming an open product carrying cavity 30 having an opening 32 at the bottom thereof. Herein, the top portion 17 defines a segmented cavity for holding two different product items, but it should be apparent that the top portion 17 may take any shape as necessary to enclose any shape or number of desired products to be carried therewithin.

The bottom portion 18 includes slanted side walls 35, slanted outward and inward end walls 36 and 37, respectively, and a bottom wall 39. The bottom portion 18 has a configuration similar to that of the top portion 17, but has a smaller cross-sectional size so that when the blister 13 is folded along the hinge line as shown by the arrow 40 in FIG. 3, the bottom portion walls 35, 36 and 37 will extend partially within the top portion 17 to contacting engage with the top portion walls 25, 26 and 27 and define a closed compartment between the top wall 29 and the bottom wall 39.

The top portion 17 includes an integral peripheral flange 45 extending outward from the bottom of the walls 25 and 26 at the lateral sides 47 and free outward end 48. The peripheral flange 45 provides some rigidity to the top portion 17 and as described hereafter provides a means for mounting the blister 13 to the carrier 12. The peripheral flange 45 has an inner part 50 adjacent the walls 25 and 26 and an outer part 51 outward of the inner part 50. The outer part 51 is formed so that it is displaced downwardly approximately the thickness of the blister material thereby defining a shallow recess 53 adjacent the cavity 30. The outer part 51 defines edges 55 at the sides and an edge 56 at the free outward end. The outer part 51 has a lower surface 58 which is secured to the front surface 15 of the carrier 13 as by heat sealing or by adhesive.

Figure 2:
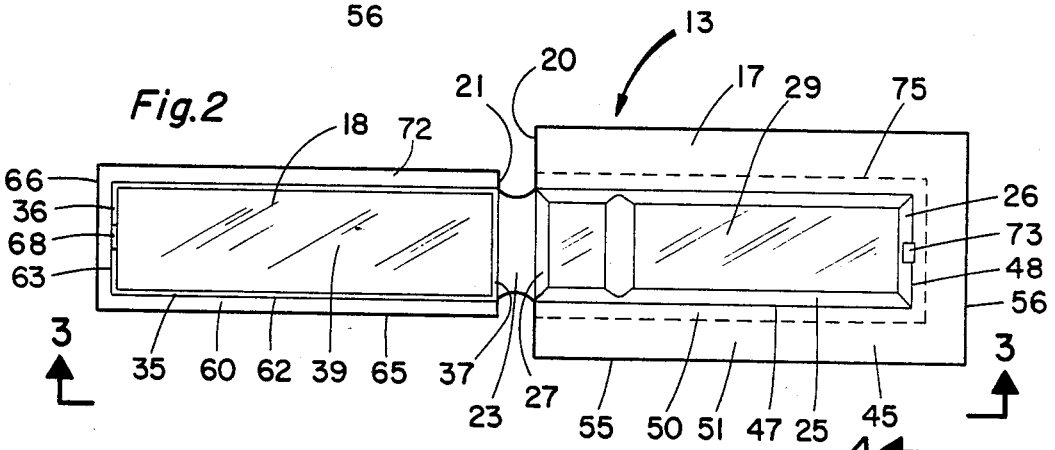
FIG. 2 is a top view of an unmounted plastic blister unfolded to an open condition.
Figure 3:
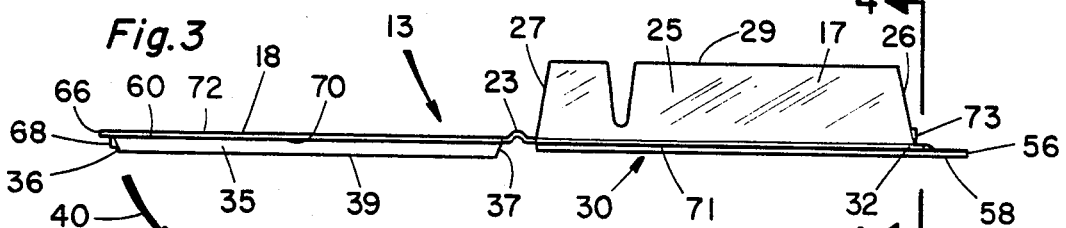
FIG. 3 is a side view of the open plastic blister of FIG. 2 taken along line 3—3.
Figure 4:
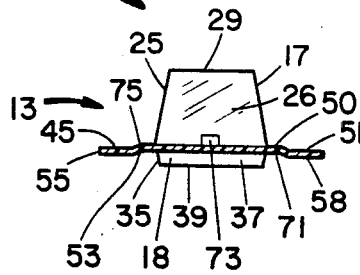
FIG. 4 is a cross-sectional end view of the open plastic blister of FIG. 3 taken along line 4—4.

The bottom portion 18 as shown herein in FIG. 2 has a small peripheral flange 60 extending outward from the top of the walls 35 and 36 at the lateral sides 62 and free outward end 63 and terminating at its lateral sides and free outward end in peripheral edges 65 and 66, respectively. Integrally defined by the outward end wall 36 adjacent the edge 66 is a protruding locking tab 68. The flange 60 provides some rigidity to the bottom portion 18.

Figure 5:
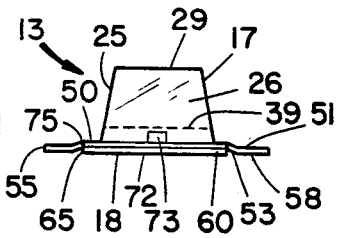
FIG. 5 is a cross-sectional end view of the unmounted plastic blister of FIG. 4 folded to a closed condition; and, FIG. 6 is an end view of another embodiment of an unmounted plastic blister folded to a closed condition.

When the blister 13 is folded at the hinge line to close the blister 13, the bottom portion flange 60 resides within the top portion recess 53 with the lower surface 70 of the bottom portion flange 60 abutting the lower surface 71 of the inner part 50 of the top portion flange 45. Thus, as seen in FIG. 5, the outer part 51 of the top portion flange 45 extends beyond the bottom portion flange 60 with the flange outer part lower surface 58 and the upper surface 72 of the bottom portion flange 60 lying in a common plane so that the blister 13 may be positioned flat on the carrier 12. The outer part 51 is then fixedly secured to the front mounting surface 15 of the carrier 12. Although the bottom portion 18 is not secured to the carrier 12, it is held closed between the top portion 17 and the carrier 12 so that the package 10 is sealed. The flange 60 prevents the bottom portion 18 from being pushed completely into the cavity 30 and provides a convenient means for manually gripping the bottom portion 18 to open the blister 13. It should be apparent however that the bottom portion flange may be eliminated in whole or part from the blister construction.

In addition, a receiving slot 73 integrally defined by the top portion end wall 26 is adapted to receive the locking cam tab 68 of the bottom portion 18. As the top portion 17 and the bottom portion 18 are folded into engagement, the blister material deflects by camming motion so that when the blister 13 is fully closed, the tab 68 and the slot 73 are locked together to resist opening until manual pressure is applied to unfold the blister 13.

On the inner part 50 of the top portion flange 45 is a score line, or series of perforations 75 cut at least partially through the thickness of the blister material. The perforations 75 extend from the inward end 20 at one side around the side walls 25 and the outward end wall 26 of the product carrying cavity 30 to the inward end 20 at the other side of the top portion 17. The perforations 75 in the top portion 17 are generally aligned with the peripheral edges 65 and 66 of the bottom portion 18.

The perforations 75 permit an individual to separate the blister 13 from the outer part 51 thereby allowing the blister 13 to be removed from the carrier 12 by manual pressure with the flange outer part 51 remaining fixed to the carrier 12. Thereafter, the blister 13 is unfolded and product is removed from the open cavity 30. The blister 13 may then be reclosed and reused by folding the top portion 17 and the bottom portion 18 together so that the respective walls wedge with one another and the locking tab 68 and slot 73 mate. The remaining flange parts protrude only slightly so that a number of these reclosed blisters may be stacked relatively close to each other and on top of one another. The slanted side walls permit the top portion of one stacked closed blister to be inserted slightly into the bottom portion of another stacked closed blister.

Figure 6:
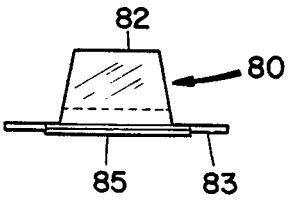

In FIG. 6, another embodiment of the blister, generally designated 80, is shown wherein the top portion 82 has an outwardly extending peripheral flange 83, which is formed with no displacement so as not to define a recess. The bottom portion 85 has no peripheral flange thereby permitting the blister 80 to lie flat against a carrier (not shown).

It should be apparent that if the bottom portion were formed with a peripheral flange and the top portion did not define a receiving recess, the outer part of the top portion flange could be forceably bent downward around the bottom portion flange to mount the blister to the carrier.

Industrial Applicability

From the foregoing, it should be apparent that the blister package provides a convenient means for displaying product in a sealed package and for storing product in a reclosable package after the package is unsealed.

Other aspects, objects and advantages of this invention can be obtained from a study of the drawings, the disclosure and the appended claims.

I claim:

1. A reclosable blister package comprising:

a supporting carrier having a front surface;

a product-carrying container having a top portion and a bottom portion;

hinge means between said top and bottom portions for folding said top portion and said bottom portion together;

said top portion having an outwardly extending peripheral flange, said flange having an outer part extending beyond said bottom portion when said top and bottom portions are folded together, said outer part being secured to said front surface of said carrier to mount the folded container thereto; and, score means defined on said flange inward of said outer part between the secured outer part and the remaining unsecured product-carrying portions of the folded container to define a separation line therebetween extending along the entire inward extent of said peripheral flange, said outer part of said peripheral flange being completely separable from the remainder of said top portion of said container along the separation line by manual pressure, whereby the product-carrying portion of said container is detachable from said carrier with the flange outer part remaining secured thereto.

2. The blister package of claim 1 wherein said top and bottom portions have inward and outward ends and lateral sides, said hinge means joins said inward ends of said top and bottom portions, said flange extends outward from the sides and outward end of said top portion, and said score means extends about said top portion along the inward extent of said flange from said inward end of said top portion at one side thereof around said outward end to said inward end of said top portion at the other side.

3. The blister package of claim 1 wherein said score means is a series of perforations cut at least partially through said top portion.

4. In a blister package for holding product including a carrier having a front mounting surface and a thermoplastic blister container for holding product, the blister container comprising:

a top portion having inward and outward ends and lateral sides and having upwardly extending side walls defining a product carrying cavity with an opening at the bottom thereof;

a bottom portion having inward and outward ends and lateral sides;

a flexible hinge portion connecting the inward ends of said top and bottom portions and permitting the bottom portion to be folded adjacent said top portion over said opening to hold product within said cavity;

a peripheral flange at the lateral sides of said top portion extending outward from said side walls, said flange having an outer part extending beyond said bottom portion when said top and bottom portions are folded together and being fixed to the front surface of the carrier to mount the folded container to the carrier;

said top portion, bottom portion, flexible hinge portion and peripheral flange being integrally formed from a single piece of thermoplastic material; and perforation score means defined on said flange inward of said outer part extending at least partially through the thickness of the container, said score means being disposed between the secured outer part and the remaining unsecured product-carrying portions of the folded container to define a separation line therebetween extending along the entire inward extent of said peripheral flange, said outer part of said peripheral flange being completely separable from the remainder of said top portion of said container along the separation line by manual pressure, whereby the product-carrying portion of said container is detachable from said peripheral flange and therefore the front surface of the carrier to which the flange was secured.

5. The blister package of 4 wherein said bottom portion has a peripheral flange extending laterally outward from the top of its lateral sides, said top portion peripheral flange extends outward beyond said bottom portion peripheral flange when said top and bottom portions are folded together, and said score means is generally aligned with the peripheral edge of said bottom portion flange.

6. The blister package of claim 4 wherein said peripheral flange extends outwardly at said outward end of said top portion, and said score means extends about said top portion along the inward extent of said flange from said inward end of said top portion at one side thereof around said outward end to said inward end of said top portion at the other side.

* * * * *